US008082871B2

(12) United States Patent
Czarnowski et al.

(10) Patent No.: US 8,082,871 B2
(45) Date of Patent: Dec. 27, 2011

(54) INFLATABLE KAYAK

(75) Inventors: James T. Czarnowski, Encintas, CA (US); Gregory S. Ketterman, Vista, CA (US); Jason Christopher Kardas, Vista, CA (US); Philip James Dow, Oceanside, CA (US)

(73) Assignee: Hobie Cat Company, Oceanside, CA (US)

( * ) Notice: Subject to any disclaimer, the term of this patent is extended or adjusted under 35 U.S.C. 154(b) by 488 days.

(21) Appl. No.: 12/220,165

(22) Filed: Jul. 21, 2008

(65) Prior Publication Data

US 2009/0031941 A1 Feb. 5, 2009

Related U.S. Application Data

(60) Provisional application No. 60/962,999, filed on Aug. 1, 2007.

(51) Int. Cl.

| | |
|---|---|
| ***B63B 7/08*** | (2006.01) |
| ***B63B 35/71*** | (2006.01) |
| ***B63H 1/30*** | (2006.01) |
| ***B63H 1/36*** | (2006.01) |
| ***B63H 16/08*** | (2006.01) |
| ***B63H 16/18*** | (2006.01) |

(52) U.S. Cl. ..... 114/345; 114/347; 440/13; 440/21

(58) Field of Classification Search ..... 114/345–347, 114/352–354; 440/21–32

See application file for complete search history.

(56) References Cited

U.S. PATENT DOCUMENTS

| | | | | |
|---|---|---|---|---|
| 35,451 | A | | 6/1862 | Johnson |
| 2,286,914 | A | | 3/1941 | Knapp |
| 2,873,713 | A | | 12/1955 | Baastrup |
| 2,743,510 | A | * | 5/1956 | Mauney et al. ..... 428/12 |
| 2,948,255 | A | | 8/1960 | Sbrana |
| 3,032,001 | A | | 8/1960 | Kiker, Jr. |
| 3,095,850 | A | | 7/1963 | Stolzer |
| 3,649,977 | A | * | 3/1972 | Grabenauer ..... 441/130 |
| 3,682,123 | A | * | 8/1972 | Edwards ..... 114/39.22 |
| 3,695,211 | A | | 10/1972 | Gross |
| 4,318,700 | A | | 3/1982 | Price |
| 4,462,331 | A | * | 7/1984 | McCrory ..... 114/345 |
| 4,474,502 | A | | 10/1984 | Daoud |
| 4,490,119 | A | | 12/1984 | Young |
| 4,511,338 | A | | 4/1985 | Fanelli |
| 4,936,802 | A | | 6/1990 | Ueno |
| 4,960,396 | A | | 10/1990 | Stolzer |

(Continued)

FOREIGN PATENT DOCUMENTS

| | | |
|---|---|---|
| GB | 452719 | 8/1936 |

(Continued)

OTHER PUBLICATIONS

Hobie Kayak Catalog: Published on the Hobiecat.com website on or before Jul. 18, 2006, downloaded using Wayback Machine application at http://web.archive.org/web/20060718165521/www.hobiecat.com/media/pdf/Hobie_Kayak.pd.*

(Continued)

*Primary Examiner* — Ajay Vasudeva

(74) *Attorney, Agent, or Firm* — Joseph E. Mueth, Esq.

(57) ABSTRACT

An air inflatable watercraft, having a cockpit with a bottom area forming part of the cockpit having a through opening therein adapted to receive a human operated propulsion mechanism which can be operated from the cockpit to propel the watercraft.

16 Claims, 14 Drawing Sheets

U.S. PATENT DOCUMENTS

| | | | | |
|---|---|---|---|---|
| 5,030,146 | A * | 7/1991 | Chung | 440/54 |
| 5,090,930 | A * | 2/1992 | Walden | 441/131 |
| 5,145,424 | A * | 9/1992 | Han | 440/13 |
| 5,170,738 | A * | 12/1992 | Patten | 114/345 |
| 5,183,422 | A | 2/1993 | Guiboche | |
| 5,194,024 | A | 3/1993 | Shiraki | |
| 5,453,031 | A | 9/1995 | Gagnier | |
| 5,460,551 | A | 10/1995 | Beres | |
| 5,481,991 | A | 1/1996 | Amdt | |
| 5,651,706 | A | 7/1997 | Kasper | |
| 6,022,249 | A * | 2/2000 | Ketterman | 440/13 |
| 6,223,678 | B1 * | 5/2001 | Haller et al. | 114/347 |
| 6,863,014 | B2 | 3/2005 | Hudson et al. | |
| 2005/0172882 | A1 * | 8/2005 | Yung | 114/345 |
| 2009/0061703 | A1 * | 3/2009 | Song et al. | 440/27 |

FOREIGN PATENT DOCUMENTS

| | | |
|---|---|---|
| JP | 52-033290 | 3/1977 |
| JP | 01-144198 | 10/1989 |
| JP | 03-035897 | 4/1991 |

OTHER PUBLICATIONS

Howe, Peter J., "Penguin Power Bids to Challenge the Propeller", The Boston Globe, May 12, 1997, p. C1.

* cited by examiner 20
14
22
12

C
B
D
A
18
34
14
16
12
D
A
C
B 20
30
32
28
22
20
18

SECTION A-A
20
18

18
SECTION B-B
18
20

SECTION C-C
16
20
18

16
SECTION D-D 12
58
18
60
B
34
20
32
14

12
58
34
SECTION A-A
14

58
60
DETAIL B
SCALE 1 : 12

A
A
12
34
14

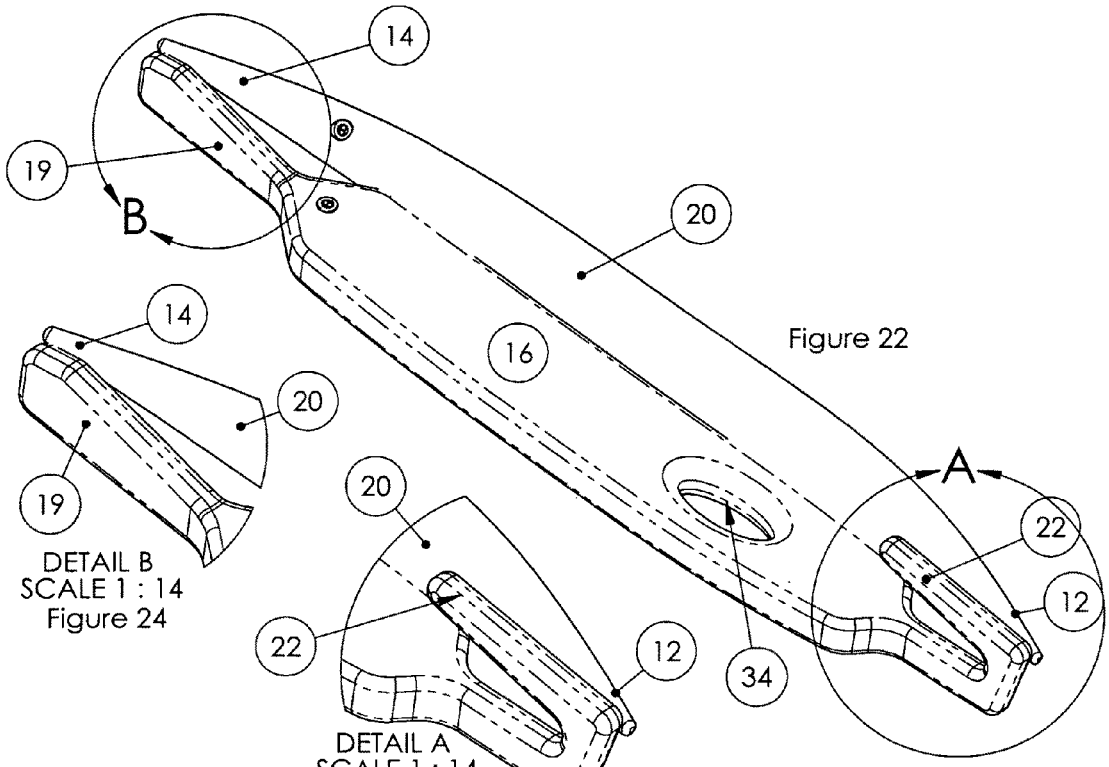
Figure 22
DETAIL B
SCALE 1 : 14
Figure 24
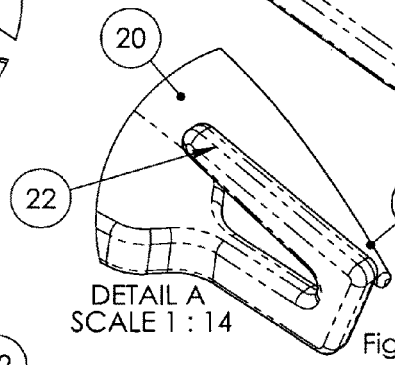
DETAIL A
SCALE 1 : 14
Figure 23
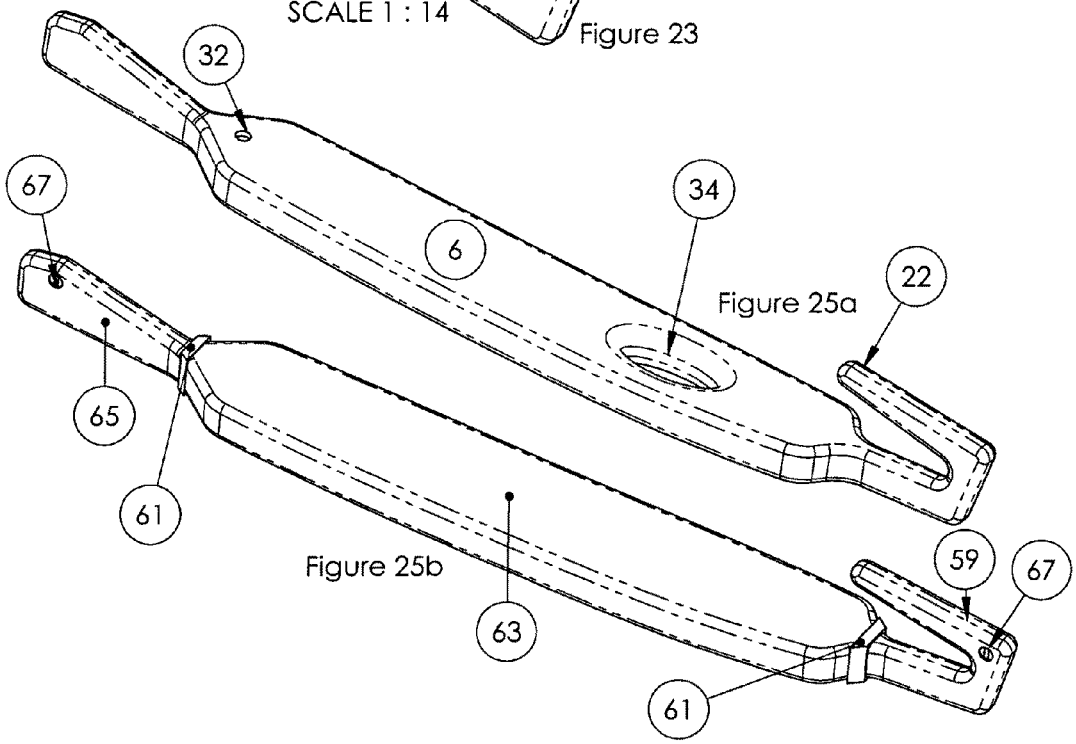
Figure 25a
Figure 25b 58
36
42
57
55
20
32
A
56
16
18
68
60
22
B 24
22
DETAIL B
SCALE 1 : 9

26
56
DETAIL A
SCALE 1 : 8

16
70
20
34
22
56
18

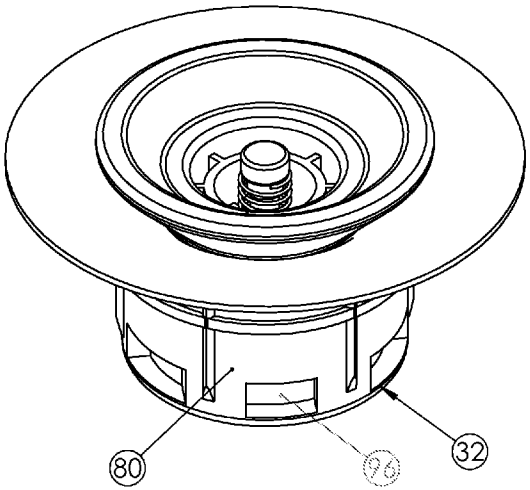
Prior Art Figure 33
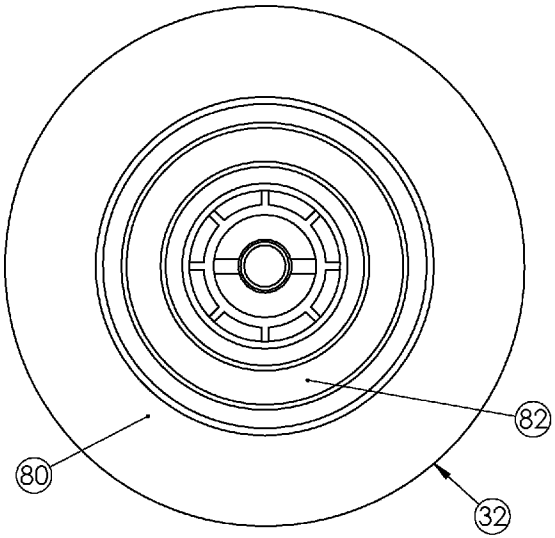
Prior Art Figure 34
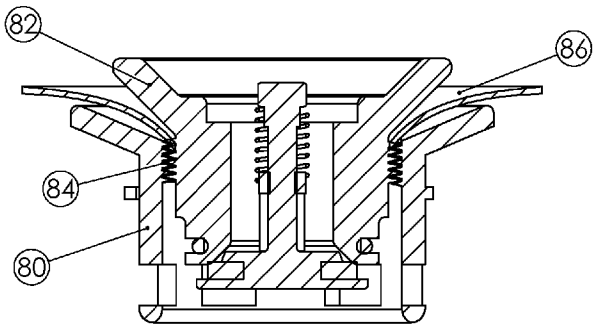
Prior Art Figure 36
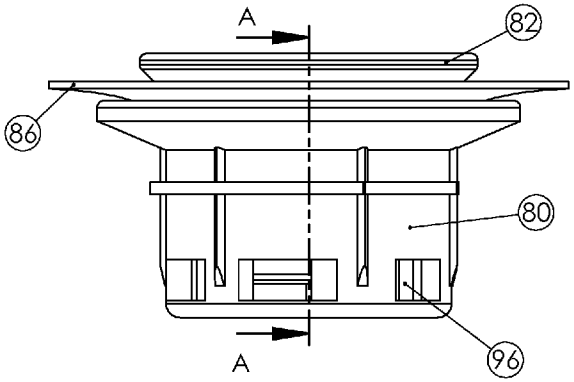
Prior Art Figure 35

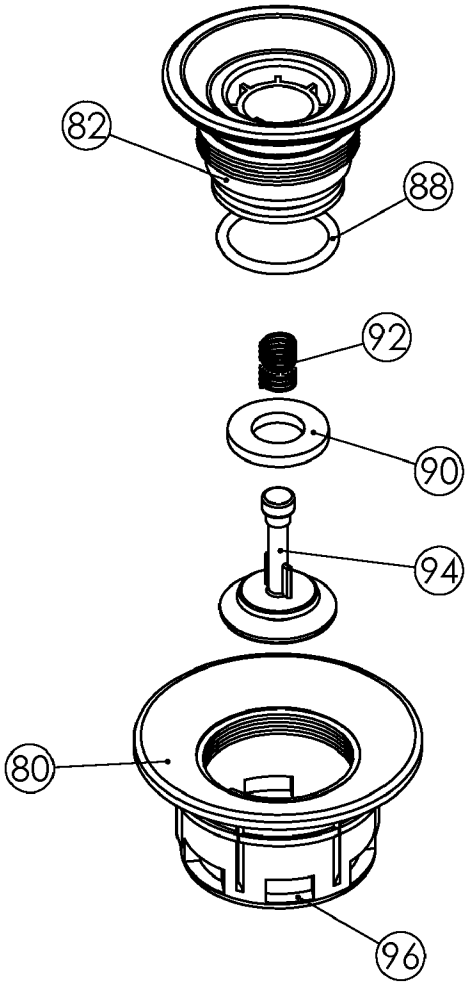
Prior Art Figure 37
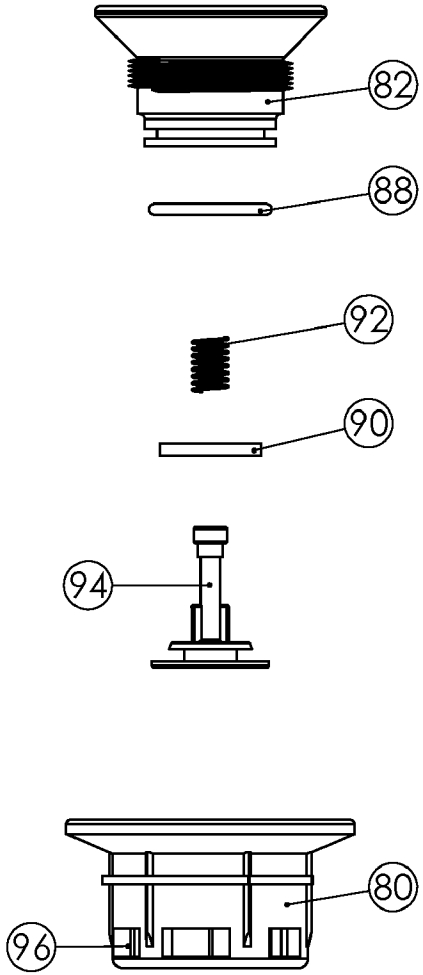
Prior Art Figure 38

INFLATABLE KAYAK

The application claims the benefit of U.S. Provisional Application No. 60/962,999, filed Aug. 1, 2007, the disclosure of which is expressly incorporated herein by reference.

FIELD OF INVENTION

This invention relates to human propelled inflatable watercraft.

BACKGROUND OF INVENTION

Many types of inflatable watercraft are known. They range in size from small inner-tube type watercraft without propulsion to kayak-like watercraft and up to large inflatable boats with outboard engines to propel them.

Kayaks including foot pedaled kayaks are known. Typically, pedalable kayaks are relatively long and made of a rigid plastic material. Consequently, for transport a pedalable kayaks must be towed from place to place on a trailer, or secured to a roof top carrier. Because they are rigid, considerable space is required for storage when the kayak is not in use and they are generally difficult to store in a garage, on a large boat or in a motor home due to it large size. With the increased emphasis on conservation, the downsizing of vehicles, and the limited storage space available in condominiums and apartments, there exists a need for a pedalable kayak which can be stored in a compact condition and yet be adapted to simple deployment at a recreational site.

SUMMARY OF THE INVENTION

An air inflatable watercraft, preferably having a bow and stern, and having a cockpit, a bottom area forming part of said cockpit having a through opening therein adapted to receive a human operated propulsion mechanism which can be operated from the cockpit to propel the watercraft.

An air inflatable watercraft having an inflatable, airtight bow and stern, and having a bottom area between two side inflatable, airtight compartments which run essentially the length of the watercraft, upon inflation the two side compartments at least partially extend above the bottom to provide a cockpit therebetween, and the inflated bow and stern form a configuration which is adapted to be efficiently propelled, viz., adapted to cut through the water. This embodiment can be hand rowed or provided with a pedaled propulsion mechanism provided a through opening is built into the bottom.

An air inflatable watercraft having a bow and stern and having a central airtight compartment and two side airtight compartments running essentially the length of the watercraft, upon inflation the central compartment forms the bottom bow and stern, and the two side compartments at least partially extend above the bottom to provide a cockpit therebetween, said central compartment having a through opening adapted to receive a human operated propulsion mechanism.

An essentially rigid hold and release well adapted to be received in a through oval opening in the bottom of an inflatable watercraft having an airtight central compartment and two side airtight compartments, said compartments running essentially the length of the watercraft, said well being of generally oval shape complementary with said oval opening, said well being open at top and bottom and having generally vertical side walls with opposed slots being received in said walls at the shortest lateral dimension of said oval, said slots terminating above the bottom of the wall.

A compact package comprising a tightly packed, inflatable watercraft, said watercraft upon being unpacked and inflated forms a bow and stern, and having a central bottom airtight compartment and two side airtight compartments running essentially the length of the watercraft, the central compartment forms the bottom and the two side compartments at least partially extend above the bottom to provide a cockpit therebetween, said central compartment having a through opening adapted to receive a human operated propulsion mechanism.

It is an important preferred aspect of this invention that the bow and stern be provided with inflatable compartments which due to the use of the "drop stitch" material discussed below, give the compartments, when inflated, shape and rigidity sufficient to hold conformable outer sheets in the configuration of a classical bow and stern, typical of watercraft such as a kayak.

The preferred inflatable watercraft of this invention is a kayak. However, other inflatable watercraft and aquatic toys are also within the scope of this invention.

THE DRAWINGS

Turning to the drawings.

FIG. 11A through D shows the steps or stages involved in following the watercraft of FIGS. 1 to 10, with rudder attached, as it is deflated and folded up for storage.

Figure 12:
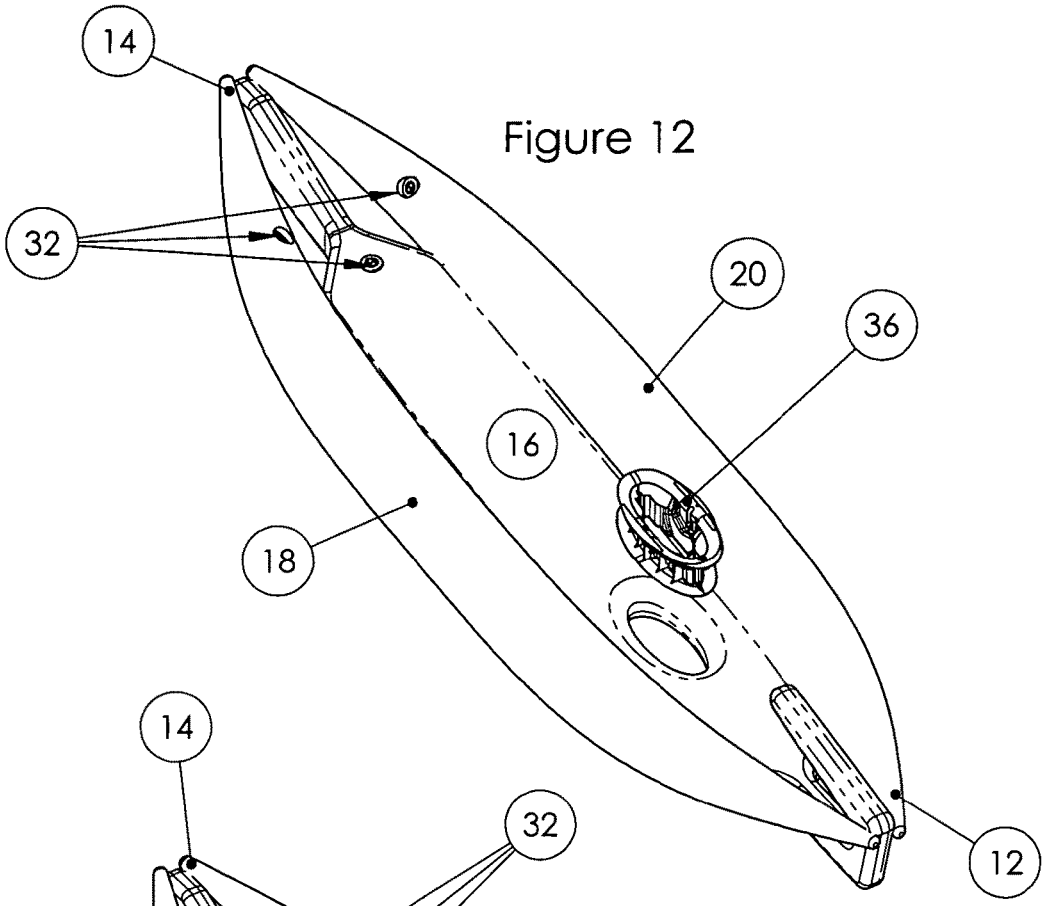

FIG. 12 is a perspective view of the inflatable watercraft of FIGS. 1 to 10 in exploded view, also showing the hold and release well for the foot operated propulsion mechanism.

Figure 13:
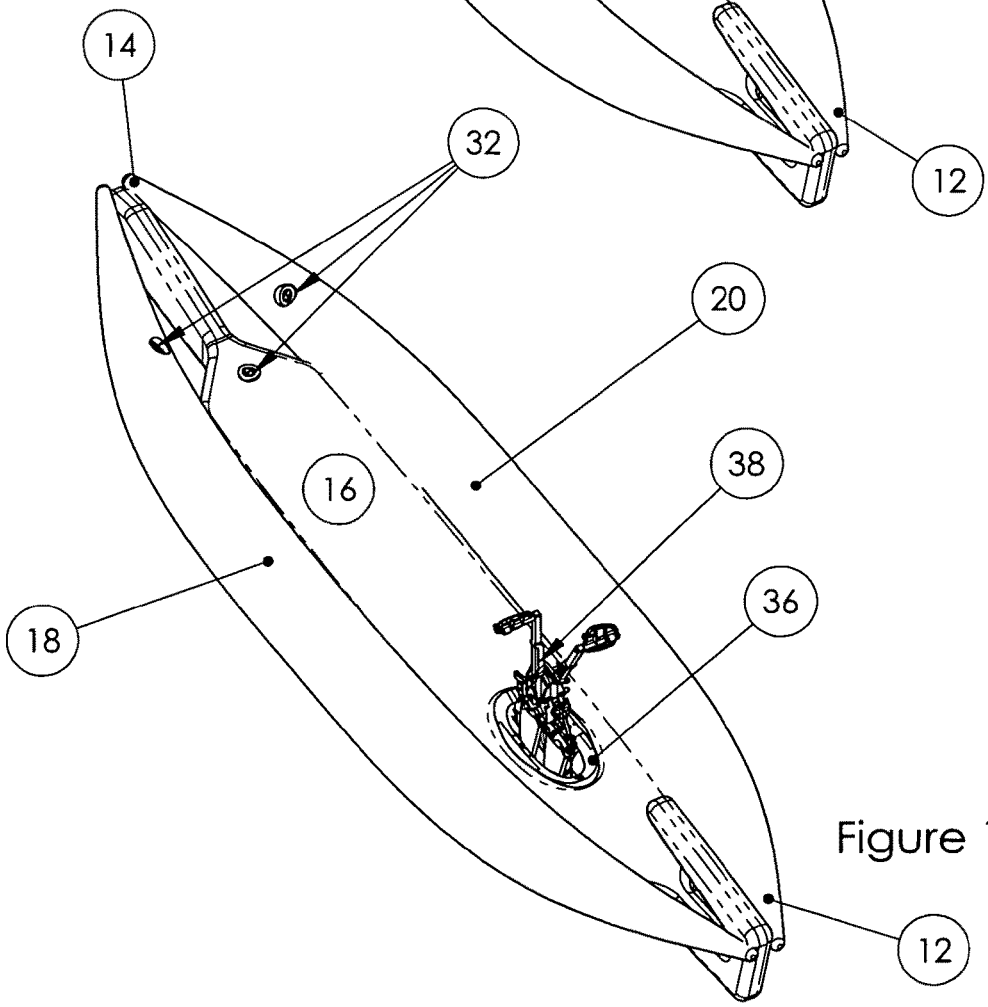

FIG. 13 shows the watercraft of FIG. 12 with the foot operated propulsion mechanism installed in the well.

Figure 14:
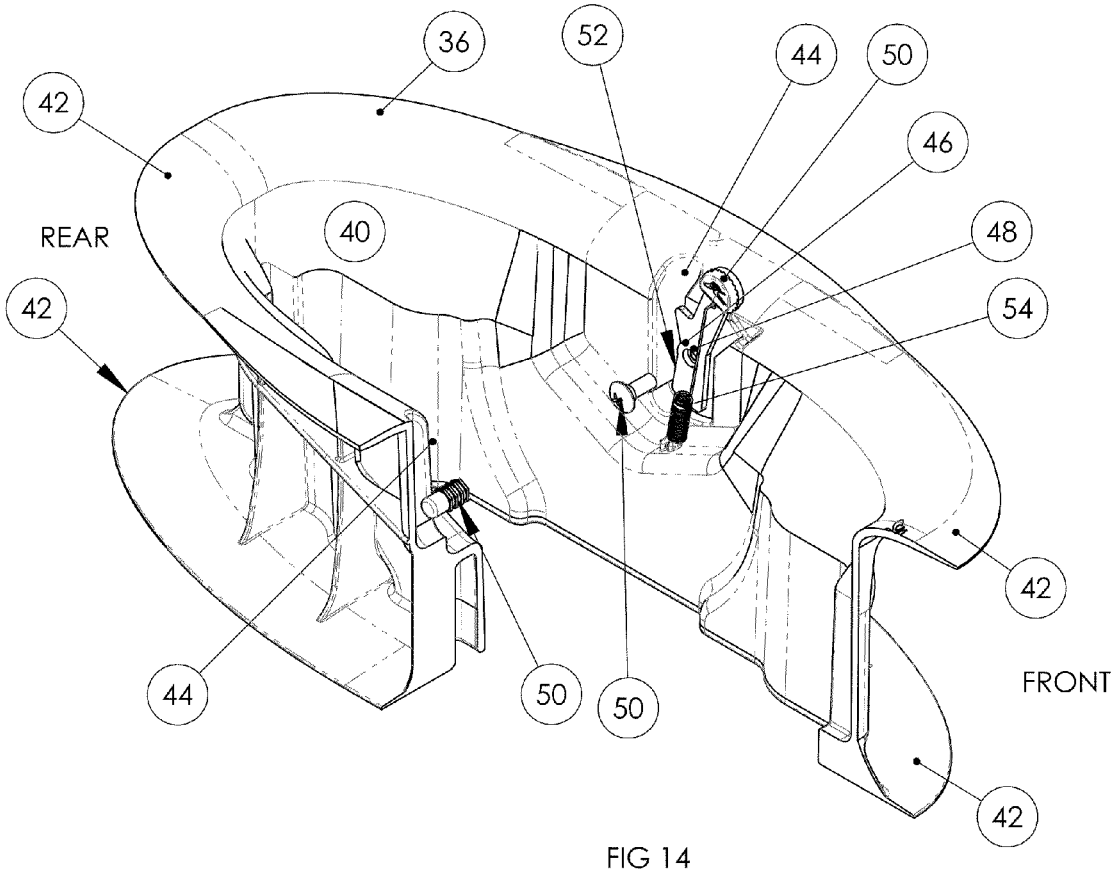

FIG. 14 is a perspective view in partial cutaway of the hold and release well of FIG. 12.

Figures 15, 16, 17, 18:
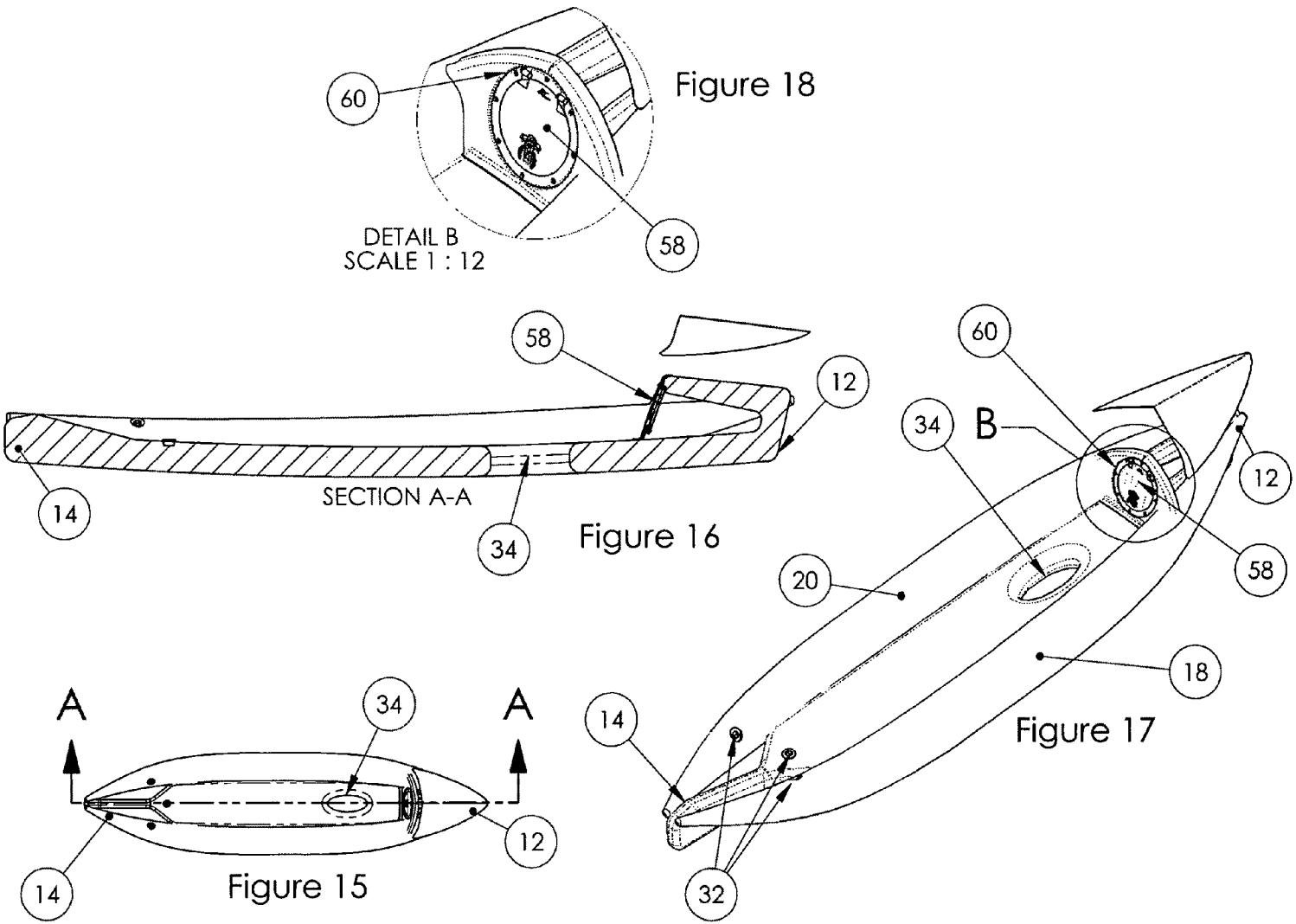

FIG. 15 is a top view of an inflatable watercraft of this invention having a firewall in the bow containing a small storage hatch with cover.

FIG. 16 is a sectional view along the line A-A in FIG. 15.

FIG. 17 is a perspective view of the watercraft of FIGS. 15 and 16.

FIG. 18 is an enlarged perspective view taken at "B" in FIG. 17.

Figure 19:
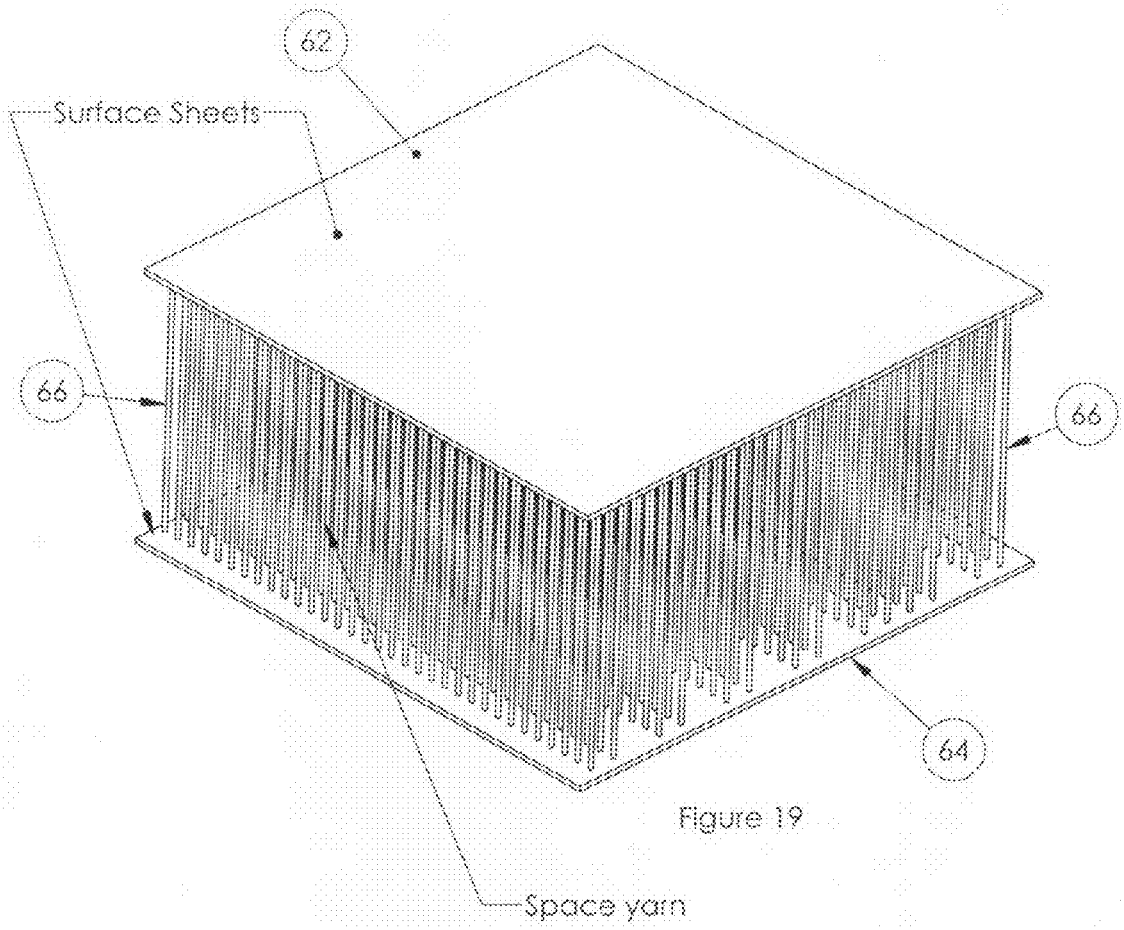

FIG. 19 is a perspective view of a cut out and removed area of one of the inflatable portions of the watercraft of this invention, in the inflated state.

Figure 20:
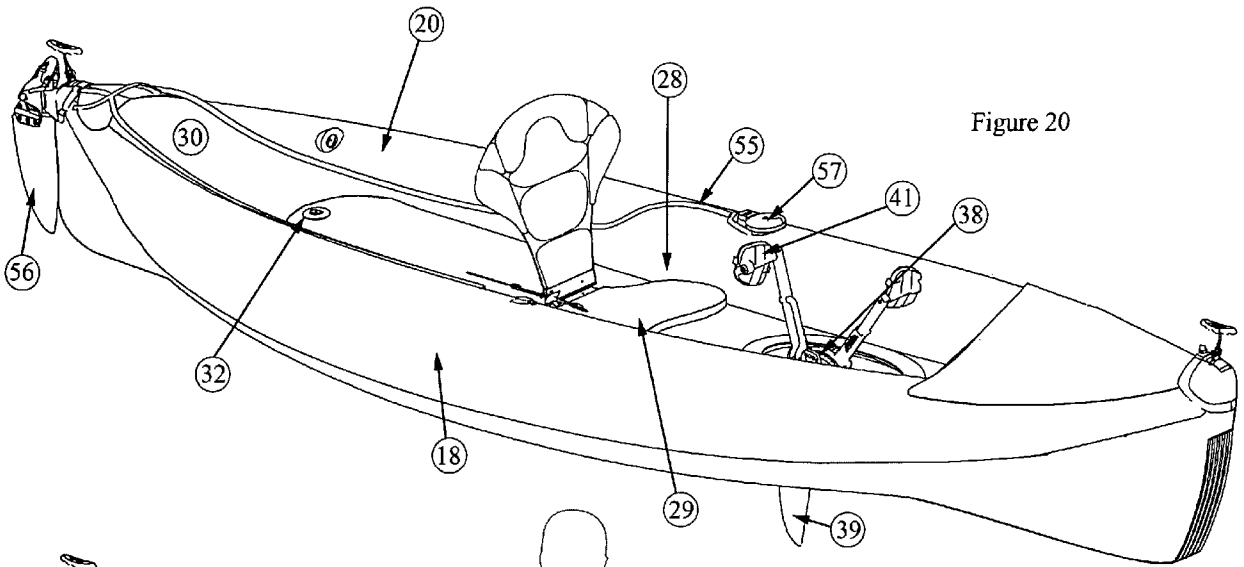

FIG. 20 is a perspective view of a kayak of this invention showing a seat in the cockpit.

Figure 21:
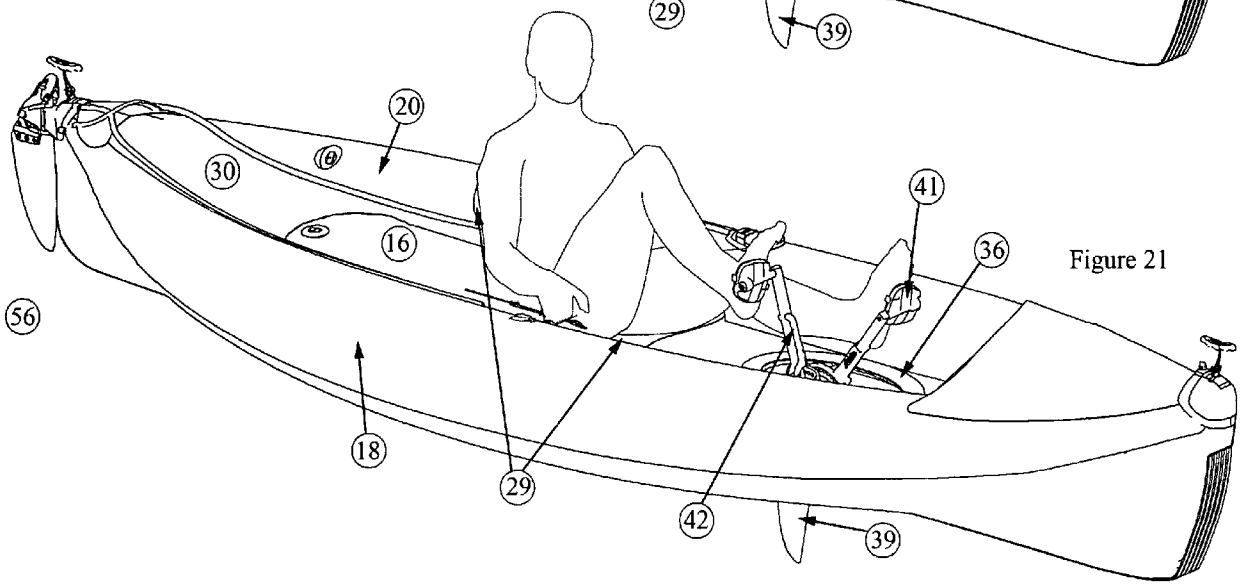

FIG. 21 shows is the kayak of FIG. 20 with a person seated with the feet on the pedals to provide propulsion.

FIG. 22 is a perspective view with side air chamber 18 removed.

FIG. 23 is taken at A in FIG. 22.

FIG. 24 is taken at B in FIG. 22.

FIG. 25A is a perspective view of the central air chamber with all other components removed for purpose of illustration.

FIG. 25B is a perspective view of an alternate embodiment of this invention wherein the bow and stern sections are airtight inflatable compartments and the section running between the bow and stern forming the bottom need not be air inflatable.

Figures 26, 27, 28, 29:
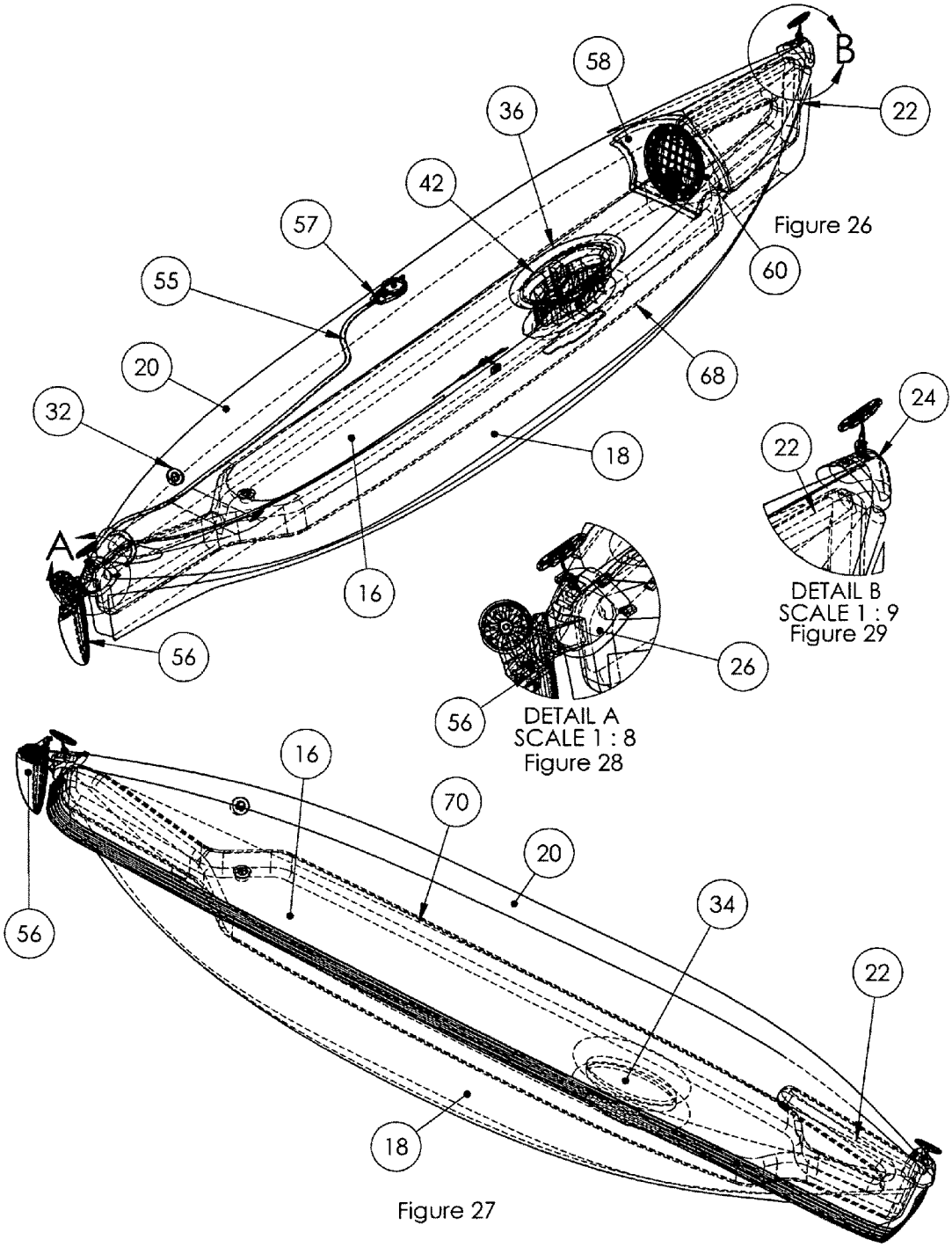

FIG. 26 is a perspective view from the side rear and above, showing generally the arrangement of the conformable upper skin elements disposed over the airtight compartments.

FIG. 27 is another perspective view from side front and above, with parts removed for purpose of illustration to better reveal the arrangement of the conformable lower skin.

FIG. 28 is taken at A in FIG. 26.

FIG. 29 is taken at B in FIG. 26.

Figure 30:
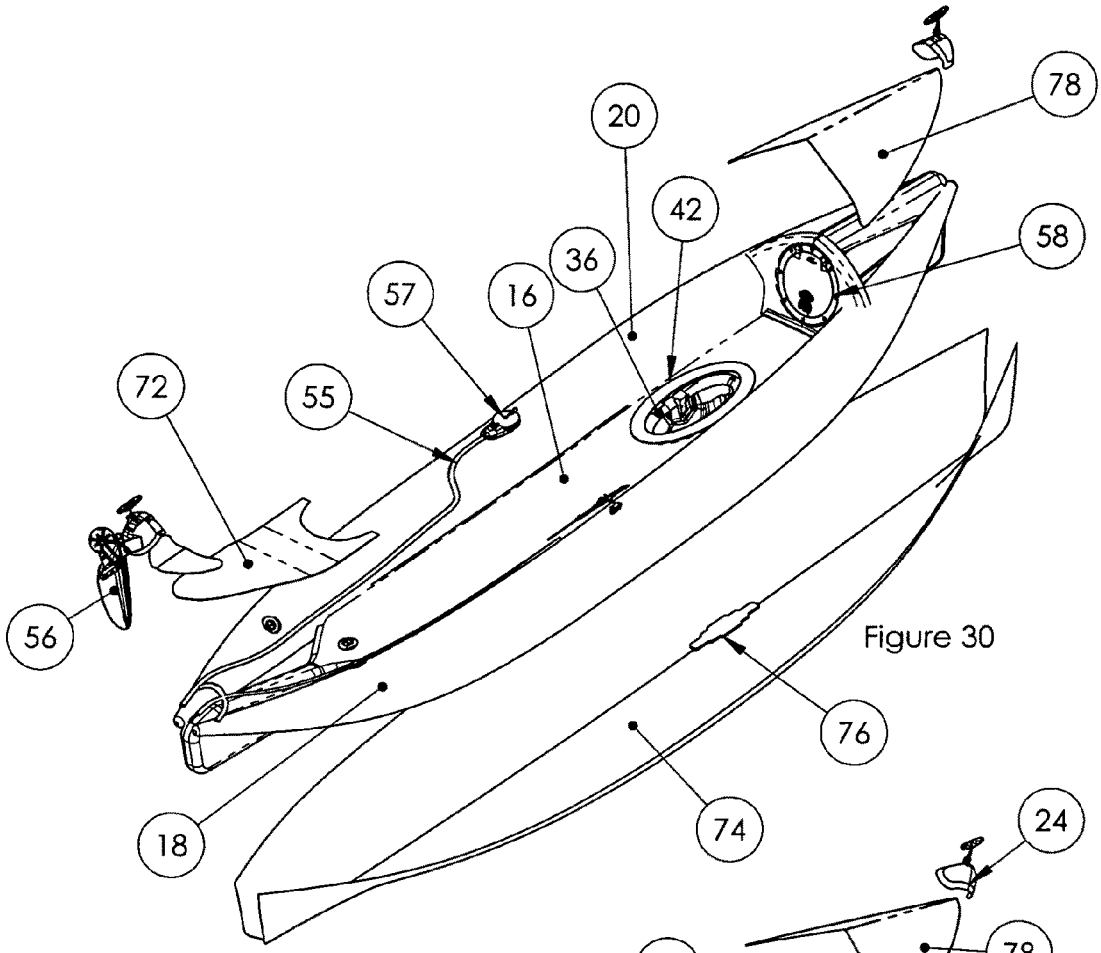

FIG. 30 is an exploded perspective view from the side rear and above, particularly showing the conformable skin elements at the top of the bow, at the rear deck adjacent the stern, and on the bottom of the watercraft.

Figure 31:
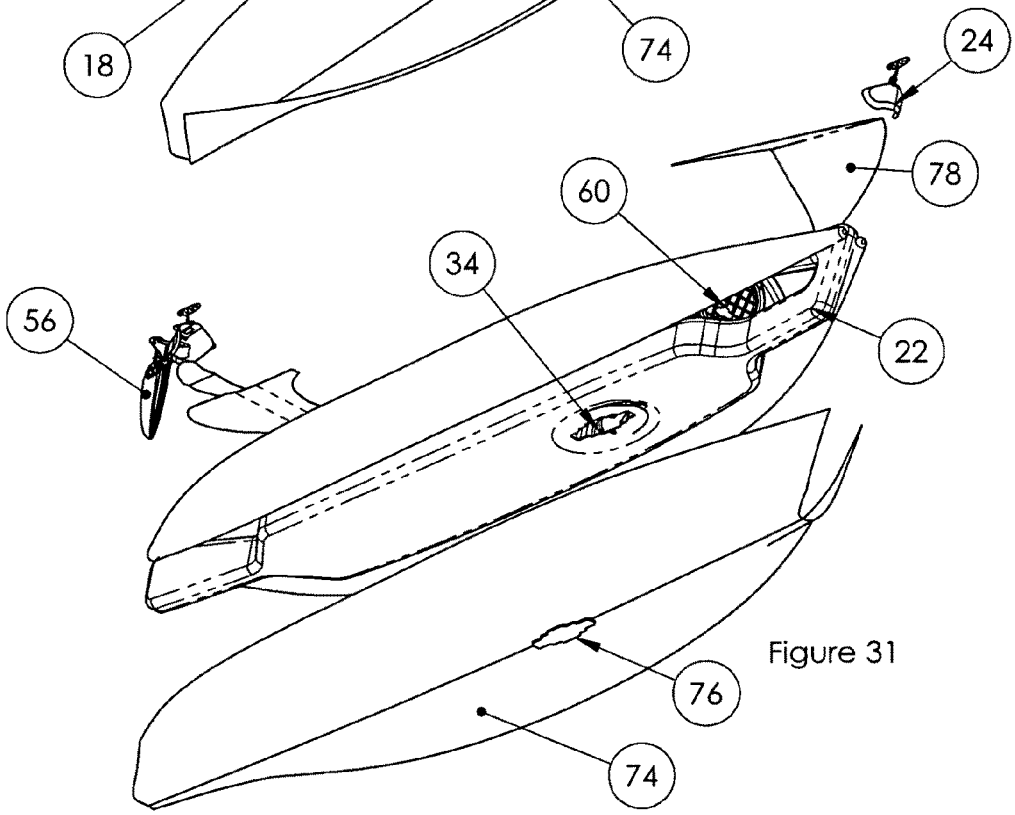

FIG. 31 is another exploded view, generally looking up at the bottom of the watercraft from just ahead of the bow.

Figure 32:
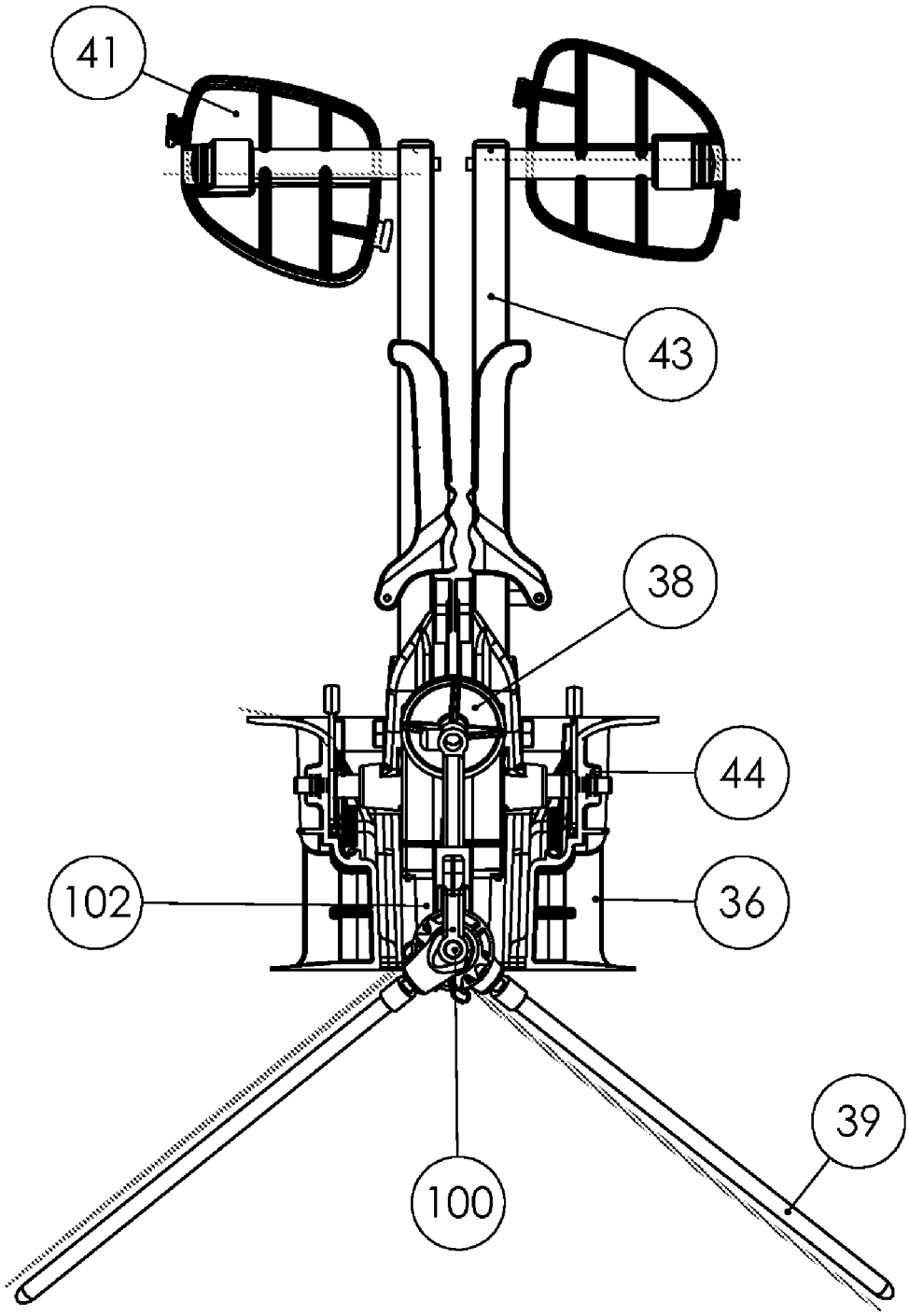

FIG. 32 is a frontal view showing the preferred foot operated propulsion mechanism with well.

FIG. 33 is a perspective view of the prior art twist and lock, open and close valve.

FIG. 34 is a top view of the prior art valve shown in FIG. 33.

FIG. 35 is a side view of the prior art valve shown in FIG. 33.

FIG. 36 is a sectional view taken along the line A-A in FIG. 35.

FIG. 37 is an exploded, perspective view of the prior art valve of FIG. 33.

FIG. 38 is an exploded side view of the prior art valve as shown in FIG. 37.

In FIGS. 1 to 10, 12, 13, 15 to 18, 20, 21 and 26 to 31, the watercraft is shown inflated with air.

DESCRIPTION OF THE PREFERRED EMBODIMENT

Turning to the drawings in more detail.

In one embodiment, the watercraft, generally 10, when inflated has a bow 12 and stem 14. The watercraft has three inflatable airtight chambers, an air chamber 16 forming the bottom or floor of the watercraft 10. The air chamber 16 extends generally from bow to stern. There are two inflatable side air chambers 18 and 20 which also extend generally from bow to stern.

Figure 2:
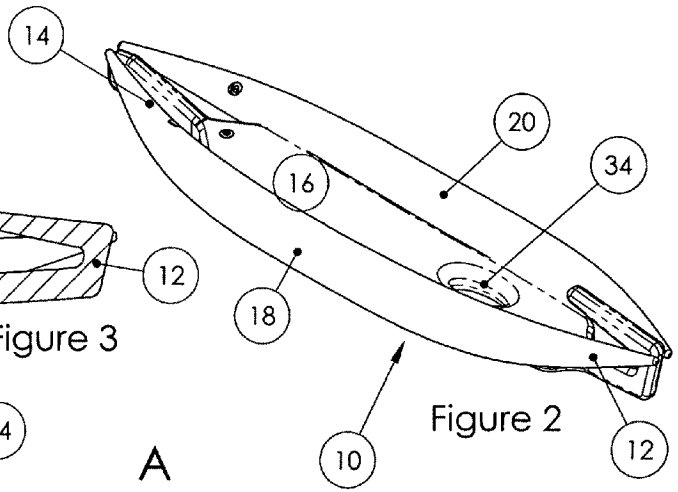
FIG. 2 is a perspective view of the inflatable watercraft of FIG. 1 from above and at the side rear of the watercraft.
Figure 4:
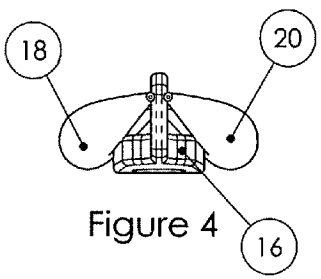
FIG. 4 is a front view of the inflatable watercraft of FIG. 1.
Figure 3:
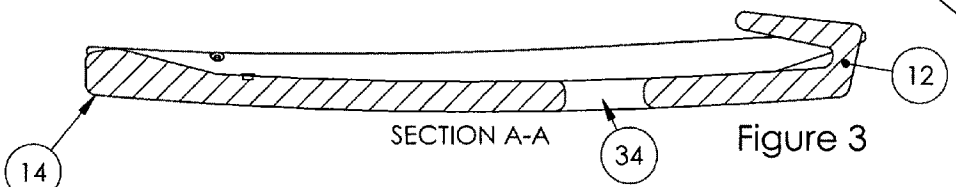
FIG. 3 is a sectional view taken along the line A-A in FIG. 1.
Figure 1:
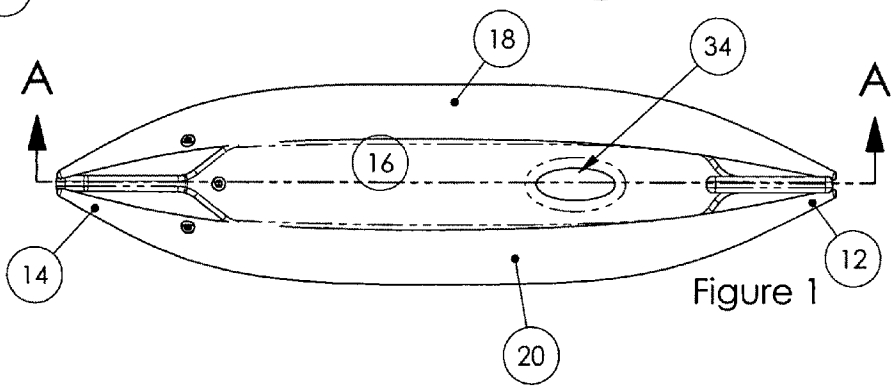
FIG. 1 is a top view of a preferred embodiment of the invention.
Figures 5, 6, 7, 8, 9, 10:
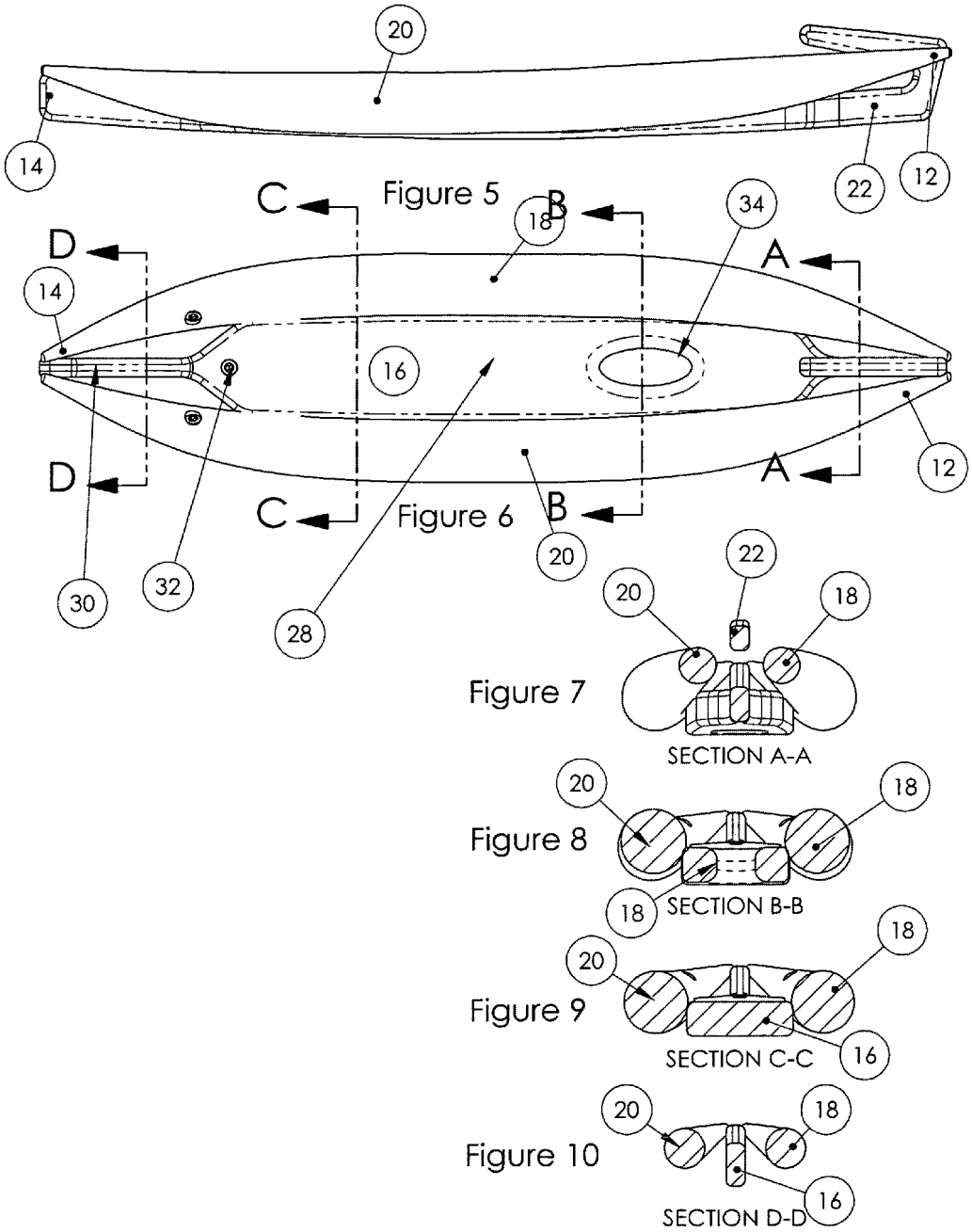
FIG. 5 is a side view of the inflatable watercraft of FIG. 1.
FIG. 6 is as in FIG. 1 showing the location of four sectional views.
FIG. 7 is a sectional view taken along the line A-A in FIG. 6.
FIG. 8 is a sectional view taken along the line B-B in FIG. 6.
FIG. 9 is a sectional view taken along the line C-C in FIG. 6.
FIG. 10 is a sectional view taken along the line D-D in FIG. 6.

At the bow, the bottom or floor air chamber 16 reduces to a narrow conduit 22 which turns up and back as shown in FIGS. 5, 7 and 22, forming, when inflated, the center of bow 12. The side air chambers 18 and 20 also narrow at the bow as shown in FIGS. 6 and 7.

At the stern 14, the bottom air chamber 16 and the side air chambers 18 and 20 also narrow at 19, as best shown in FIG. 22. All of the air chambers are enclosed in a flexible outer plastic cover layer which snugly conforms to the underlying structure.

The central or bottom air chamber 16 at its extremities, form the bow and the stern.

The extremities of the bow and stern can be fitted with hard, molded plastic end caps 24 and 26. The exterior of the center line of the bow and stern can be provided with glued on external semi-rigid rubber stiffeners, shown at the bow in FIGS. 20 and 21.

When inflated, the two side air chambers 18 and 20 project above the floor air chamber 16 provide a cockpit 28 therebetween. Normally, a seat 29 is provided in the cockpit for the person pedaling the watercraft, as discussed below. The upper surface of the stern provides a raised deck area 30.

Inflation of air chambers 16, 18 and 20 is accomplished by injecting air through twist and lock, open and close valves 32. Air can be provided either from a source of pressurized air, or by using a manual hand pump.

As shown FIGS. 33 to 38, the prior art twist and lock, open and close valve 32 has two major parts, a housing 80 and an inner member 82 which is received in housing 80. The inner member 82 has threads 84 which engage with complementary threads in housing 80. The edge or lip 86 around an opening in the drop stitch material of elements 62, 64 and 66 is engaged and held in the threads 84 when member 82 is twisted or screwed into housing 80.

The member 82 includes seals 88 and 90, spring 92 and stemmed valve 94. When an air hose is connected to member 82 and member 82 is advanced into housing 80, the spring 92 is compressed, opening valve 94, allowing air to pass through openings 96 and into air compartments 16, 18, 20, 59 and 65 to inflate the watercraft 10.

There is an opening 34 in the center and extending through the bottom or floor air chamber 16. Opening 34 is adapted to receive oval hold and release well 36, shown in partial breakaway in FIG. 14. Hold and release well 36 is adapted to receive the foot operated propulsion mechanism 38.

The hold and release well 36 is of generally oval shape having generally vertical side walls 40 running completely around the oval, the top and bottom of the oval being open. The upper and lower extremities of the walls 40 terminating in upper and lower outwardly projecting flanges 42. The space between the flanges 42 receives and snugly abut the oval opening 34 in the bottom airtight compartment 16, the oval opening 34 and oval well 36 being complementary size and shape. The wall 40 of oval well 36 has opposed identical slots 44 at the shortest lateral dimension of the oval which is adapted to receive a transverse shaft forming part of the preferred foot operated propulsion mechanism 38.

The hold and release well 36 is normally fairly rigid and is made of an injection moldable plastic.

The preferred foot operated propulsion mechanism 38 used in the practice of the invention is described in U.S. Pat. No. 6,022,249 issued Feb. 8, 2000, the disclosure of which is expressly incorporated herein by reference. The mechanism has propulsion means extending below the water line comprising a pair of flexible flappers 39 each adapted to oscillate through an arcuate path in a generally transverse direction with respect to the central longitudinal dimension of the watercraft about an axis which is at or below the bottom of the watercraft and are each carried by a support 102 which rotates about a common longitudinal shaft 100. The flappers 39 are adapted to simultaneously reverse direction at opposite ends of said arcuate path. The flexible flappers 39 can twist to form an angle of attack for providing forward thrust with respect to the longitudinal dimension of the watercraft while moving in both directions along said arcuate path.

The propulsion system 38 can also be operated by hand. Each of said flappers 39 is carried by a mast with each of the flappers being sufficiently rotatable about the mast so that the flapper produces forward thrust with respect to the longitudinal dimension of said hull while moving in both directions along said arcuate path.

The means for applying propulsive force, propulsion system 38, normally includes a pair of pedals 41 and pedal shafts 43 operatively associated with the propulsion means.

The pair of pedals 41 and pedal shafts 43 are carried by a common transverse shaft. The ends of this shaft are received in slot 44.

Pivotally mounted release cams 46 are rotatably attached to walls 40 of oval well 36 by threaded members 48. Members 48 pass through holes in cams 46, the holes being large enough so that the cams rotate freely on the threaded members 50.

The transverse shaft carrying propulsion mechanism 38 can be lowered into the two opposite slots 44 at each side of the short dimension of oval well 36 after cams 46 have been rotated to the rear by pulling back on the upper ends 50 of cams 46 which causes the lower ends 52 to clear the slot 44. Once the transverse shaft is seated at the bottom of each slot 44, the cams 46 can be released. The cams 46 are provided with biasing springs 54 which pull down on the upper ends 50 of cams 46, locking the lower ends 52 of the cam over the transverse shaft of the propulsion mechanism 38 and holding it in place in slot 44.

Once installed, a person seated to the rear of the propulsion mechanism can readily pedal, to provide propulsive force to the watercraft 10.

Normally, the watercraft 10 is provided with a rudder 56.

The preferred rudder mechanism for the practice of this invention is described in U.S. non-provisional application Ser. No. 11/881,136, filed on Jul. 24, 2007, now U.S. Pat. No. 7,430,976, which claims priority from provision patent application No. 60/835,271, filed on Aug. 2, 20006, entitled "Twist and Stow Rudder", the disclosures of which are expressly incorporated herein by reference.

The preferred rudder system has a rudder 56 which is connected to the rear of the watercraft 10 is provided with retraction mechanism enabling rudder to pivot on an axis such that when the rudder is retracted, it rotates upwardly through about 270° from the normal operating position in the water while twisting about 90° so as to lay essentially flat on the deck area 30. The retraction system has control lines 55 to rotate the rudder up and down and for turning the rudder while in the normal operating position to the left or right about a vertical axis, the lines 55 being operably connected to control means 57 adjacent the cockpit In a preferred embodiment of this invention, the watercraft 10 has a firewall 58 located ahead of the hold and release well 34. Ahead of the firewall 58 is a storage hatch 60, the cover of the hatch being flush mounted with the firewall 58. The hatch is received above the bottom airtight compartment 16 and between side airtight compartments 18 and 20.

The preferred storage hatch and cover in the firewall is described in U.S. non-provisional application Ser. No. 11/888,826, filed on Aug. 1, 2007, which claims priority from provision patent application No. 60/836,166, filed on Aug. 7, 20006, entitled "Twist-N-Seal Hatch", the disclosures of which are expressly incorporated herein by reference.

The preferred hatch is constructed with the hatch cover having a handle hinged to the hatch.

There are cooperating means on the hatch and cover including cam surfaces whereby the handle can be rotated to secure the cover to the hatch.

A significant feature of this invention is the construction of the air compartments 16, 18 and 20, as well as compartments 59 and 65 described below. These compartments comprise two spaced-apart airtight surface sheets 62 and 64, normally of a flexible, air impenetrable plastic. Running between these spaced-apart surface sheets are space yarn 66 which are essentially not subject to stretch. As a consequence, the space yarn maintain the surface sheets 62 and 64 at a predetermined, desired separation corresponding to the length of the space yarn. Elements 62, 64 and 66 form what is sometimes called a "drop stitch" material. The space between the surface sheets surrounding the yarn is inflated with air. By appropriate selection of the length of the space yarn, it is possible to obtain inflated compartments of any chosen dimension and shape. At the same time, upon deflation, the surface sheets can collapse nearly together since the space yarn is low in bulk and occupies little space.

Turning to the alternative embodiment of FIG. 25B, the bow airtight compartment 59 is joined by connector 61 to a bottom or floor section 63 which need not be inflatable. Inflatable stern compartment 65 is also joined to floor section 63 by a connector 61. Compartments 59 and 65 are inflated via valves 67. The structure of FIG. 25B is used in an air inflatable watercraft having an inflatable, airtight bow and stern, and having a bottom area between two side inflatable, airtight compartments which run essentially the length of the watercraft, upon inflation the two side compartments at least partially extend above the bottom to provide a cockpit therebetween, and the inflated bow and stern form a configuration which is adapted to be efficiently propelled, viz., adapted to cut through the water. This embodiment can be hand rowed or provided with a pedaled propulsion mechanism provided a through opening is built into the bottom.

The airtight compartments in each embodiment are enclosed in a thin flexible plastic sheet. Top sheet or cover 68 is draped over the firewall and bow structure. To attach it to the watercraft, the top cover material 68 is glued or otherwise adhered to the sides of tubes 18 and 20 and to the firewall 58. The upper flange 42 of well 36 is glued on top of the floor sheet 70. Another sheet 72 covers the top of the stern and keeps water from entering the bilge area.

The bottom sheet 74 is also glued to the well 36, with a cut-out 76 being provided therein so that the propulsion mechanism can penetrate into the water. Gluing the bottom sheet 74 to the well 36 also provides a watertight seal to keep water from getting into the bilge.

The bow cap 24 is glued to hold the bow sheet 78 and bottom sheet 74 together as they join at the bow, FIG. 29.

The stern cap 26 is glued to hold the sheets together as they join at the stern, FIG. 28.

Figure 11A:
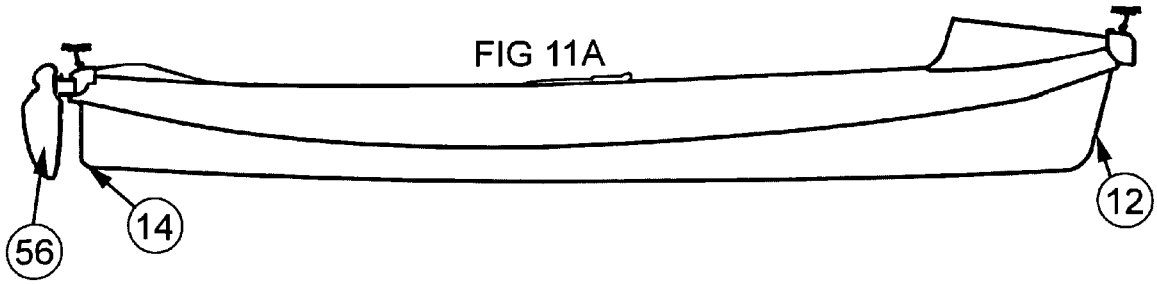
Figure 11B:
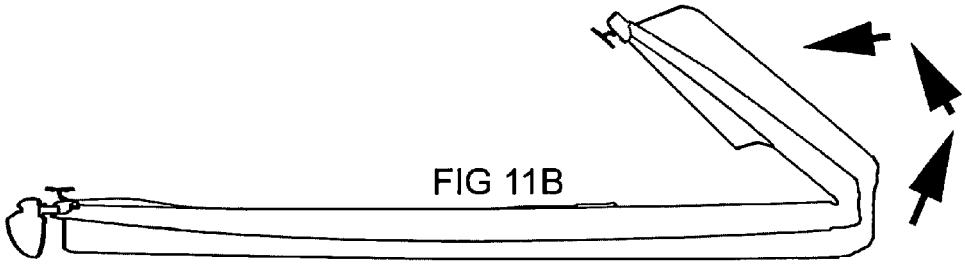
Figure 11C:
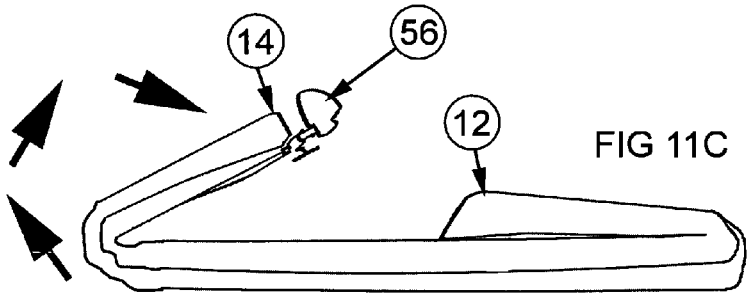
Figure 11D:
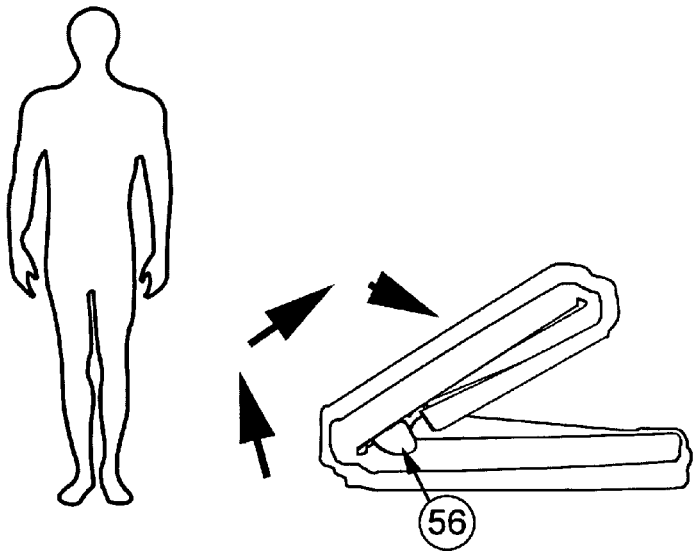

Yet another important feature of this invention is shown in FIGS. 11A to 11D which illustrates the preferred manner in which the watercraft of this invention, after being deflated, can be folded into a compact package for storage and transport. As shown in the FIG. 11A to D sequence, the deflated watercraft can be first folded by folding the bow backed to the midpoint as shown in FIGS. 11B and C. Likewise, the stern, if desired, with rudder can be folded forward to the midpoint, FIG. 11C. Then the entire watercraft is folded in half again, FIG. 11D, at which point the deflated, tightly folded watercraft can be placed in a carrying bag or simply tied up.

The deflated watercraft can also be simply rolled up or folded up in various other ways. In any case, an 8 to 10 foot watercraft is made into a compact package without the need for any disassembly except for the removal of the propulsion system 38 from the oval hold and release well 36 followed, if desired, by the removal of the oval hold and release well 36 itself.

In use, the deflated watercraft is simply removed from its carrying bag, or untied if a bag is not in use, and laid out on a flat surface, usually at or near the water's edge. The oval hold and release well 36 is inserted into opening 34, and air is pumped into compartments 16, 18 and 20 via valves 32. The space between outwardly projecting flanges 42 receives and snugly abut the oval opening 34 in bottom airtight compartment 16 as compartment 16 is filled with air. The propulsion mechanism 38 is then inserted into well 36, the transverse rod of the propulsion mechanism resting on the bottom of slots 44, and locked into place by the pivotally mounted release cams 46.

An essentially rigid hold and release well adapted to be received in a through oval opening in the bottom of an inflatable watercraft having an airtight central compartment and two side airtight compartments. The compartments run essentially the length of the watercraft. The well is of generally oval shape complementary with the oval opening. The well is open at top and bottom and has generally vertical side walls. Opposed slots are received in the walls at the shortest lateral dimension of the oval, the slots terminating above the bottom of the wall.

The invention claimed is:

1. An air inflatable watercraft, having a cockpit, a bottom area forming part of said cockpit having a through opening therein, a substantially rigid well with open top and bottom and vertical sidewalls defining a longitudinal passage therethrough, said well being releasably received in said through opening and supporting a foot operated propulsion mechanism therein for operation of said propulsion mechanism from said cockpit to propel the watercraft, said propulsion mechanism having propulsion means extending below the water line comprising a pair of flexible flappers each adapted to oscillate through an arcuate path in a generally transverse direction with respect to the central longitudinal dimension of the watercraft about an axis which is at or below the bottom of said watercraft and each carried by a support which rotates about a common longitudinal shaft, said flappers being adapted to simultaneously reverse direction at opposite ends of said arcuate path.

2. The inflatable watercraft of claim 1 wherein the watercraft has inflatable bow and stern compartments.

3. The inflatable watercraft of claim 1 in the form of a kayak.

4. An air inflatable watercraft having an inflatable, airtight bow and stern, and having a bottom area between two side inflatable, airtight compartments which run essentially the length of the watercraft, upon inflation the two side compartments at least partially extend above the bottom area to provide a cockpit therebetween, and the inflated bow and stern form a watercraft configuration which is adapted to be efficiently propelled, said bottom area forming part of said cockpit having a through opening therein, a substantially rigid well with open top and bottom and vertical sidewalls defining a longitudinal passage therethrough, said well being releasably received in said through opening and supporting a foot operated propulsion mechanism therein which can be operated from the cockpit to propel the watercraft, said propulsion mechanism having propulsion means extending below the water line comprising a pair of flexible flappers each adapted to oscillate through an arcuate path in a generally transverse direction with respect to the central longitudinal dimension of the watercraft about an axis which is at or below the bottom of the watercraft and each carried by a support which rotates about a common longitudinal shaft, said flappers being adapted to simultaneously reverse direction at opposite ends of said arcuate path, the flexible flappers being twistable to form an angle of attack for providing forward thrust with respect to the longitudinal dimension of the watercraft while moving in both directions along said arcuate path.

5. The inflatable watercraft of claim 4 wherein the watercraft is a kayak.

6. An air inflatable watercraft having a bow and stern and having a central airtight compartment and two side airtight compartments running essentially the length of the watercraft, upon inflation the central compartment forms the bottom and the two side compartments at least partially extend above the bottom to provide a cockpit therebetween, said central compartment having a through opening adapted to receive a foot operated propulsion mechanism, a hold and release well being received in said through opening, said hold and release well being open at top and bottom and having generally vertical side walls with opposed slots being received in said walls at or near the shortest lateral dimension of said well, said slots terminating above the bottom of said walls.

7. The watercraft of claim 6 having a deck area near the stern and wherein a rudder is carried at the stern which when not in use can be rotated upwardly from its normal operating position in the water and twisted lay essentially flat on the deck area.

8. The watercraft of claim 6 wherein said airtight compartments comprise air-impermeable spaced apart flexible surface sheets having space yarns running therebetween.

9. The watercraft of claim 6 wherein a seat is provided to the rear of said opening and a firewall ahead of said opening, a storage hatch is positioned ahead of the firewall and the hatch cover is essentially flush with said firewall.

10. The watercraft of claim 6 wherein said compartments comprise a plastic material.

11. The watercraft of claim 6 wherein the craft is a kayak.

12. A compact package comprising a tightly packed, inflatable watercraft, said watercraft upon being unpacked and inflated forms a bow and stern, and having a central bottom airtight compartment and two side airtight compartments running essentially the length of the watercraft, the central compartment forms the bottom and the two side compartments at least partially extend above the bottom to provide a cockpit therebetween, said central compartment having a through opening therein, a substantially rigid well with open top and bottom and vertical sidewalls defining a longitudinal passage therethrough, said well being releasably received in said through opening and supporting a foot operated propulsion mechanism therein operable from said cockpit, said propulsion mechanism having propulsion means extending below the water line comprising a pair of flexible flappers each adapted to oscillate through an arcuate path in a generally transverse direction with respect to the central longitudinal dimension of the watercraft about an axis which is at or below the bottom of said watercraft and each carried by a support which rotates about a common longitudinal shaft, said flappers being adapted to simultaneously reverse direction at opposite ends of said arcuate path.

13. The package of claim 12 wherein said compartments comprise a plastic material.

14. The package of claim 12 wherein said airtight compartment comprises impermeable spaced-apart flexible surface sheets having space yarns running therebetween of predetermined lengths which resist stretching upon inflation.

15. The package of claim 12 wherein each of said compartments have twist and lock, open and close air valves.

16. The package of claim 12 wherein the watercraft is a kayak.

* * * * *